US009597540B2

(12) United States Patent
Arnold

(10) Patent No.: US 9,597,540 B2
(45) Date of Patent: Mar. 21, 2017

(54) ADAPTIVE MOTION EXERCISE DEVICE

(75) Inventor: Peter J. Arnold, Snohomish, WA (US)

(73) Assignee: Precor Incorporated, Woodinville, WA (US)

( * ) Notice: Subject to any disclaimer, the term of this patent is extended or adjusted under 35 U.S.C. 154(b) by 630 days.

(21) Appl. No.: 13/372,842

(22) Filed: Feb. 14, 2012

(65) Prior Publication Data

US 2013/0210585 A1 Aug. 15, 2013

(51) Int. Cl.

| | |
|---|---|
| ***A63B 22/04*** | (2006.01) |
| ***A63B 22/00*** | (2006.01) |
| ***A63B 71/00*** | (2006.01) |
| ***A63B 21/005*** | (2006.01) |
| ***A63B 21/00*** | (2006.01) |
| ***A63B 21/22*** | (2006.01) |
| ***A63B 22/20*** | (2006.01) |
| ***A63B 24/00*** | (2006.01) |
| *A63B 22/06* | (2006.01) |

(52) U.S. Cl.

CPC ..... *A63B 21/0052* (2013.01); *A63B 21/154* (2013.01); *A63B 21/225* (2013.01); *A63B 22/001* (2013.01); *A63B 22/201* (2013.01); *A63B 24/0087* (2013.01); *A63B 2022/0682* (2013.01); *A63B 2225/50* (2013.01)

(58) Field of Classification Search

CPC . A63B 22/04; A63B 22/0048; A63B 22/0664; A63B 21/0052; A63B 22/0015; A63B 22/0017; A63B 22/001; A63B 22/0012; A63B 22/0023; A63B 22/201; A63B 22/20; A63B 2022/067; A63B 2022/0676; A63B 22/06; A63B 22/0506; A63B 22/203; A63B 22/205; A63B 2022/0611; A63B 2022/0635; A63B 23/04; A63B 23/0405; A63B 23/0423

USPC ..... 482/51, 52, 61, 66, 67, 4–7, 57, 63, 903

See application file for complete search history.

(56) References Cited

U.S. PATENT DOCUMENTS

| | | | | |
|---|---|---|---|---|
| 5,067,710 | A | 11/1991 | Watterson et al. | 482/3 |
| 5,242,343 | A | 9/1993 | Miller | 482/57 |
| 5,383,829 | A | 1/1995 | Miller | 482/57 |
| 5,387,169 | A | 2/1995 | Wang | 482/73 |
| 5,489,249 | A | 2/1996 | Brewer et al. | 482/5 |
| 5,512,025 | A | 4/1996 | Dalebout et al. | 482/6 |
| 5,518,473 | A | 5/1996 | Miller | 482/57 |
| 5,562,574 | A | 10/1996 | Miller | 482/51 |
| 5,577,985 | A | 11/1996 | Miller | 482/52 |

(Continued)

*Primary Examiner* — Sundhara Ganesan
*Assistant Examiner* — Nyca T Nguyen
(74) *Attorney, Agent, or Firm* — Terence P. O'Brien; Todd A. Rathe

(57) ABSTRACT

An exercise device includes first and second crank arms configured to rotate 180 degrees out of phase with respect to one another about a first axis; a track; first and second foot links, first and second footpads carried by the first and second foot links between the first link portion and the second link portion and first and second front arms. Each of the first and second foot links has a first link portion that moves along the track while pivoting. Each of the first and second front arms has a first arm portion pivotally coupled to one of the foot links and a second arm portion pivotally coupled one of the crank arms. In one embodiment, a disc rotates in response to movement of the first foot link along the track, wherein a magnet facing the disc forms an eddy brake.

8 Claims, 4 Drawing Sheets

(56) References Cited

U.S. PATENT DOCUMENTS

| | | | | |
|---|---|---|---|---|
| 5,611,756 | A | 3/1997 | Miller | 482/52 |
| 5,685,804 | A | 11/1997 | Whan-Tong et al. | 482/51 |
| 5,755,642 | A | 5/1998 | Miller | 482/51 |
| 5,788,609 | A | 8/1998 | Miller | 482/51 |
| 5,788,610 | A | 8/1998 | Eschenbach | 482/52 |
| 5,846,166 | A * | 12/1998 | Kuo | 482/52 |
| 5,911,649 | A | 6/1999 | Miller | 482/52 |
| 5,919,118 | A | 7/1999 | Stearns et al. | 482/51 |
| 5,957,814 | A * | 9/1999 | Eschenbach | A63B 22/001 482/51 |
| 6,019,710 | A * | 2/2000 | Dalebout et al. | 482/70 |
| 6,024,676 | A | 2/2000 | Eschenbach | 482/51 |
| 6,036,622 | A | 3/2000 | Gordon | 482/51 |
| 6,042,512 | A * | 3/2000 | Eschenbach | 482/52 |
| 6,045,487 | A | 4/2000 | Miller | 482/52 |
| 6,053,847 | A * | 4/2000 | Stearns et al. | 482/51 |
| 6,123,650 | A | 9/2000 | Birrell | 482/70 |
| 6,135,927 | A * | 10/2000 | Lo | 482/57 |
| 6,146,313 | A | 11/2000 | Whan-Tong et al. | 482/51 |
| 6,152,859 | A | 11/2000 | Stearns | 482/52 |
| 6,165,107 | A | 12/2000 | Birrell | 482/70 |
| 6,196,948 | B1 | 3/2001 | Stearns et al. | 482/52 |
| 6,210,305 | B1 * | 4/2001 | Eschenbach | 482/52 |
| 6,277,054 | B1 | 8/2001 | Kuo | 482/51 |
| 6,361,476 | B1 * | 3/2002 | Eschenbach | 482/52 |
| 6,390,953 | B1 | 5/2002 | Maresh et al. | 482/52 |
| 6,390,954 | B1 * | 5/2002 | Lee | 482/52 |
| 6,422,976 | B1 * | 7/2002 | Eschenbach | 482/52 |
| 6,447,424 | B1 | 9/2002 | Ashby et al. | 482/8 |
| 6,454,682 | B1 * | 9/2002 | Kuo | 482/52 |
| 6,461,277 | B2 | 10/2002 | Maresh et al. | 482/52 |
| 6,482,130 | B1 | 11/2002 | Pasero et al. | 482/51 |
| 6,612,969 | B2 | 9/2003 | Eschenbach | 482/51 |
| 6,749,540 | B1 | 6/2004 | Pasero et al. | 482/52 |
| 6,808,472 | B1 | 10/2004 | Hickman | 482/8 |
| 6,840,892 | B1 | 1/2005 | Wu | 482/51 |
| 6,939,271 | B1 | 9/2005 | Whan-Tong et al. | 482/52 |
| 6,991,587 | B1 | 1/2006 | Eschenbach | 482/52 |
| 6,994,657 | B1 | 2/2006 | Eschenbach | 482/52 |
| 7,022,049 | B2 | 4/2006 | Ryan et al. | 482/52 |
| 7,025,711 | B2 | 4/2006 | Eschenbach | 482/52 |
| 7,052,438 | B2 | 5/2006 | Eschenbach | 482/52 |
| 7,083,549 | B1 | 8/2006 | Fan | 482/52 |
| 7,104,929 | B1 | 9/2006 | Eschenbach | 482/52 |
| 7,121,984 | B1 | 10/2006 | Hong | 482/52 |
| 7,132,531 | B1 | 11/2006 | Wellings et al. | 536/25.3 |
| 7,169,088 | B2 | 1/2007 | Rodgers, Jr. | 482/52 |
| 7,169,089 | B2 * | 1/2007 | Rodgers, Jr. | 482/52 |
| 7,172,531 | B2 | 2/2007 | Rodgers, Jr. | 482/52 |
| 7,175,568 | B2 | 2/2007 | Eschenbach | 482/52 |
| 7,179,201 | B2 | 2/2007 | Rodgers, Jr. | 482/52 |
| 7,201,705 | B2 | 4/2007 | Rodgers, Jr. | 482/52 |
| 7,214,168 | B2 | 5/2007 | Rodgers, Jr. | 482/52 |
| 7,223,209 | B2 * | 5/2007 | Lee | 482/52 |
| 7,226,392 | B2 | 6/2007 | Hong | 482/52 |
| 7,244,217 | B2 | 7/2007 | Rodgers, Jr. | 482/52 |
| 7,244,218 | B1 | 7/2007 | Lin et al. | 482/52 |
| 7,276,017 | B2 * | 10/2007 | Chen | 482/52 |
| 7,316,632 | B2 | 1/2008 | Rodgers, Jr. | 482/52 |
| 7,377,881 | B2 | 5/2008 | Moon | 482/52 |
| 7,485,072 | B2 | 2/2009 | Chuang et al. | 482/52 |
| 7,494,447 | B2 | 2/2009 | Eschenbach | 482/52 |
| 7,494,448 | B2 | 2/2009 | Eschenbach | 482/52 |
| 7,494,449 | B2 | 2/2009 | Eschenbach | 482/57 |
| 7,497,808 | B2 | 3/2009 | Eschenbach | 482/52 |
| 7,507,184 | B2 | 3/2009 | Rodgers, Jr. | 482/52 |
| 7,507,185 | B2 | 3/2009 | Eschenbach | 482/52 |
| 7,520,839 | B2 | 4/2009 | Rodgers, Jr. | 482/52 |
| 7,530,926 | B2 | 5/2009 | Rodgers, Jr. | 482/52 |
| 7,556,590 | B2 | 7/2009 | Watterson et al. | 482/8 |
| 7,556,591 | B2 | 7/2009 | Chuang et al. | 482/52 |
| 7,604,573 | B2 | 10/2009 | Dalebout et al. | 482/52 |
| 7,632,219 | B2 * | 12/2009 | Ohrt et al. | 482/52 |
| 7,641,598 | B2 | 1/2010 | Rodgers, Jr. | 482/52 |
| 7,645,212 | B2 | 1/2010 | Ashby et al. | 482/8 |
| 7,651,446 | B1 | 1/2010 | Eschenbach | 482/52 |
| 7,678,025 | B2 | 3/2010 | Rodgers, Jr. | 482/52 |
| 7,704,192 | B2 | 4/2010 | Dyer et al. | 482/52 |
| 7,704,193 | B2 * | 4/2010 | Liao et al. | 482/57 |
| 7,708,668 | B2 | 5/2010 | Rodgers, Jr. | 482/51 |
| 7,708,669 | B2 | 5/2010 | Rodgers, Jr. | 482/52 |
| 7,717,828 | B2 | 5/2010 | Simonson et al. | 482/52 |
| 7,731,635 | B2 | 6/2010 | Dyer | 482/52 |
| 7,749,137 | B2 * | 7/2010 | Watt et al. | 482/52 |
| 7,785,235 | B2 * | 8/2010 | Lull et al. | 482/52 |
| 7,789,800 | B1 | 9/2010 | Watterson et al. | 482/8 |
| 7,794,362 | B2 | 9/2010 | Miller | 482/52 |
| 7,811,208 | B2 | 10/2010 | Rodgers, Jr. | 482/52 |
| 7,828,698 | B2 | 11/2010 | Rodgers, Jr. | 482/52 |
| 7,833,133 | B2 | 11/2010 | Stewart et al. | 482/52 |
| 7,841,968 | B1 | 11/2010 | Eschenbach | 482/52 |
| 7,874,963 | B2 | 1/2011 | Grind | 482/71 |
| 7,878,947 | B1 | 2/2011 | Rodgers, Jr. | 482/52 |
| 7,887,465 | B2 | 2/2011 | Uffelman | 482/52 |
| 7,922,625 | B2 | 4/2011 | Grind | 482/52 |
| 7,938,754 | B2 | 5/2011 | Eschenbach | 482/52 |
| 7,988,600 | B2 | 8/2011 | Rodgers, Jr. | 482/52 |
| 7,993,247 | B1 | 8/2011 | Eschenbach | 482/52 |
| 8,021,275 | B2 | 9/2011 | Rodgers, Jr. | 482/52 |
| 8,029,415 | B2 | 10/2011 | Ashby et al. | 482/49 |
| 8,029,416 | B2 | 10/2011 | Eschenbach | 482/52 |
| 8,092,351 | B1 | 1/2012 | Rodgers, Jr. | 482/52 |
| 8,105,213 | B2 | 1/2012 | Stewart et al. | 482/52 |
| 8,663,070 | B2 * | 3/2014 | Long | 482/52 |
| 2004/0224825 | A1 | 11/2004 | Giannelli et al. | 482/52 |
| 2004/0248709 | A1 | 12/2004 | Rodgers, Jr. | 482/83 |
| 2005/0124467 | A1 | 6/2005 | Rodgers, Jr. | 482/52 |
| 2006/0189447 | A1 | 8/2006 | Dyer et al. | 482/52 |
| 2007/0087906 | A1 | 4/2007 | Rodgers, Jr. | 482/52 |
| 2007/0087907 | A1 | 4/2007 | Rodgers, Jr. | 482/52 |
| 2007/0219061 | A1 | 9/2007 | Rodgers, Jr. | 482/52 |
| 2007/0219062 | A1 | 9/2007 | Rodgers, Jr. | 482/52 |
| 2007/0232457 | A1 * | 10/2007 | Porth | 482/51 |
| 2007/0298936 | A1 | 12/2007 | Ohrt et al. | 482/52 |
| 2008/0064572 | A1 | 3/2008 | Nardone | 482/52 |
| 2009/0156369 | A1 | 6/2009 | Rodgers, Jr. | 482/52 |
| 2009/0156370 | A1 | 6/2009 | Rodgers, Jr. | 482/52 |
| 2010/0167878 | A1 | 7/2010 | Grind | 482/52 |
| 2011/0065551 | A1 * | 3/2011 | Eschenbach | 482/52 |
| 2011/0294627 | A1 * | 12/2011 | Lai | 482/70 |

* cited by examiner

ADAPTIVE MOTION EXERCISE DEVICE

BACKGROUND

Some exercise devices allow those persons exercising to change or adapt the shape of the path of motion by altering the application of force to foot pads. However, such exercise devices may be complex, require a high number of parts, be costly and be structurally challenging, and result in cantilevering large loads.

DETAILED DESCRIPTION OF THE EXAMPLE EMBODIMENTS

Figure 1:
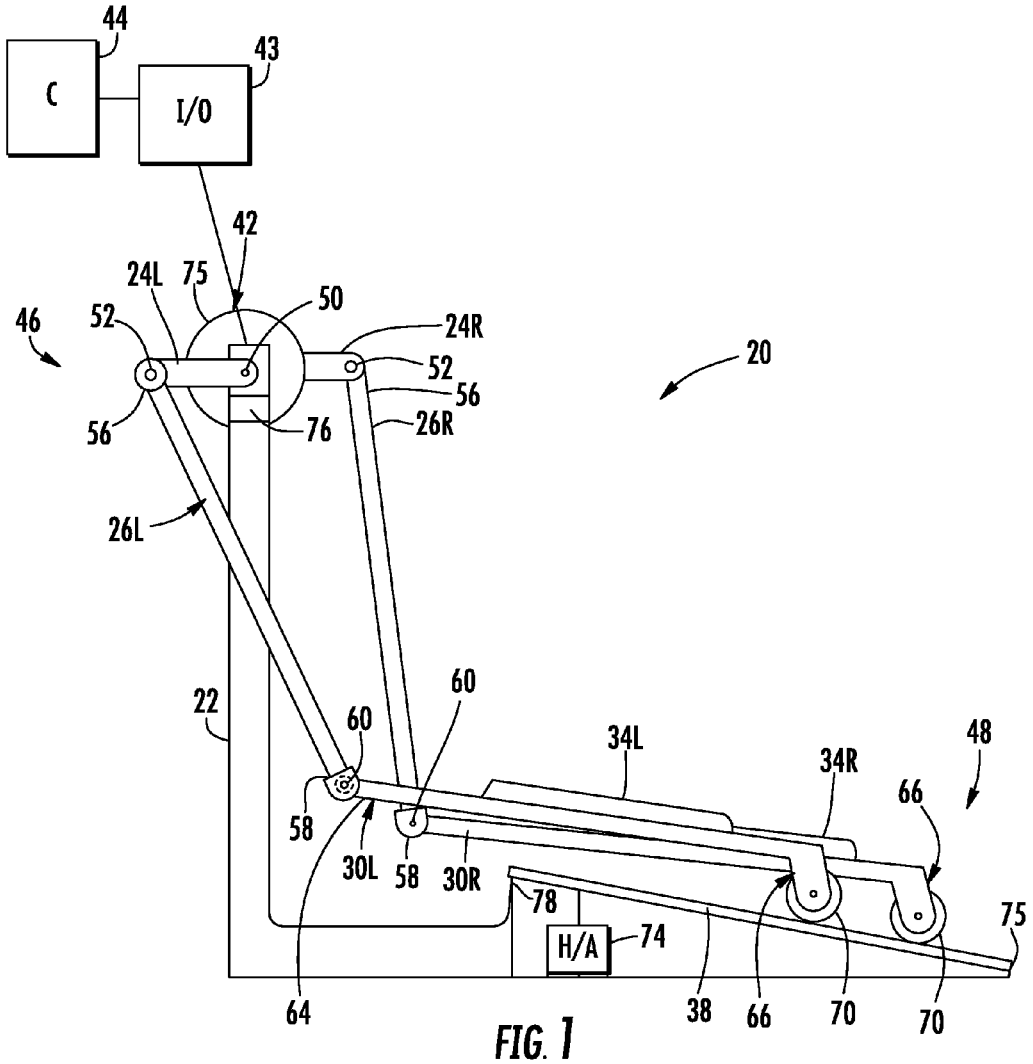
FIG. 1 is a side elevational view of an exercise device according to an example embodiment with portions schematically illustrated.

FIG. 1 illustrates an adaptive motion exercise device 20 according to an example embodiment. Exercise device 20 enables a person exercising to adjust, while exercising, the shape of the path along which his or her feet travel while applying force to the exercise device. Such adjustments occur automatically solely in response to different horizontal and vertical forces being applied during exercise.

Exercise device 20 comprises frame 22, crank arms 24R, 24L (collectively referred to as crank arms 24), front arms 26R, 26L (collectively referred to as front arms 26), foot links 30R, 30L (collectively referred to as foot links 30), footpads 34R, 34L (collectively returned to patch 34), track 38, vertical resistance source 42, input-output panel 43 and controller 44. Frame 22 comprises one or more structures that serve as a base, foundation or support for the remaining elements or components of exercise device 20. Frame 22 includes a front or forward end 46 and a back or rearward end 48. Exercise device 20 is arranged such that a person exercising generally faces forwardly towards end 46.

Crank arms 24 comprise one or more members rotationally supported by frame 22 so as to rotate about a horizontal axis 50 while being rotationally or pivotally coupled to front arms 26 at pivot joints 52. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. As shown by FIG. 1, pivot joints 52 rotate about axis 50 180 degrees out of phase with respect to one another. Crank arms 24 facilitate vertical displacement of footpads 34.

Front arms 26 comprise arms or linkages having a first portion 56 pivotally or coupled to crank arms 24 at pivot joints 52 and a second portion 58 coupled to foot links 34 at pivot joints 60. As will be described in more detail hereafter, front arms 26 enable a person exercising to vary the relative horizontal and vertical displacement of footpads 34 by merely changing or adjusting the direction and duration of force being applied to footpads 34 (and swing arms in those exercise devices having swing arms).

Foot links 30 comprise structures or members configured to movably support the weight of a person exercising as the person's feet move through selectively adjustable paths having different shapes. Each of foot links 30 includes a forward portion 64 rotationally coupled to one of front arms 26 and a rearward portion 66 configured to move along track 38. In the example illustrated, each rearward portion 66 includes a roller 70 that rolls along track 38. In other embodiments, other low friction or movement facilitating interfaces may be provided to facilitate movement of foot links 30 along track 38.

Footpads 34 comprise structures supported by foot links 30 configured to support and receive the feet of a person exercising and to further facilitate the transmission of force to foot links 30. In one embodiment, footpads 34 may include a toe clip. In other embodiments, foot pads 34 may be omitted, wherein force is directly transmitted to foot links 30.

In the example illustrated, foot pads 34 are elongated, offering a person to choose from amongst multiple different locations along foot links 30 to place his or her feet. As a result, a person may effectively change his or her vertical step height without any other mechanical changes. In the example illustrated, each foot pad 34 has a length of at least 10 inches and nominally about 25 inches. In other embodiments, foot pads 34 may have other lengths and configurations.

Track 38 comprises one or more structures configured to support foot links 30. In one embodiment, track 38 is additionally configured to guide and direct forward and rearward movement of foot links 30. In the example illustrated, track 38 comprises a single structure guiding and directing both foot links 30. In another embodiment, track 38 may comprise two separate tracks guiding foot links 30. Track 38 is located at the rear of frame and is straight or linear. In other embodiments, track 38 may alternatively be curved or be inclined at other angles than the particular angle illustrated.

In some embodiments, the incline of track 38 may be selectively adjustable. For example, exercise device 20 may include a track height adjuster 74 configured to raise and lower track 38. In one embodiment, track 38 may pivot about a pivot joint or hinge 75, whereas an upper end is supported by height adjuster 74 or by an alternative support 78. In one embodiment, track height adjuster 74 may be a manually powered adjuster wherein the track 38 is lifted or lowered and retained in place by a pin or other retention mechanism or wherein a manually powered screw is used to raise and lower track 38. In another embodiment, a powered actuator, such as a solenoid or hydraulic/pneumatic cylinder assembly, is used to raise or lower and retain track 38. In one embodiment, the powered actuator may raise or lower the track 38 in response to control signals from controller 44 based upon commands entered by the person exercising using panel 43 or based upon an exercise program or regimen being carried out under the direction of the controller 44.

Vertical resistance source 42 comprises a mechanism configured to provide an adjustable source of resistance against vertical displacement of foot links 30. In particular, vertical resistance source 42 resists rotation of crank arms 24 about axis 50. In the example illustrated, vertical resistance source 42 comprises a disc 75 and a magnetic member 76. Disc 75 comprises a nonferrous (aluminum or copper) disc coupled to crank arms 24 so as to rotate with crank arms 24. Magnetic member 76 comprises a member facing disc 74 and configured to apply a selectively adjustable magnetic field to disc 75 so as to form an Eddy brake. In one embodiment, member 76 applies a magnetic field strength under the direction or control of controller 44. In another embodiment, source 42 may provide a fixed resistance or may comprise other resistance sources such as a frictional resistance or a hysteresis brake.

Input-output panel 43, schematically shown, comprises a control panel supported by frame 22 and configured to provide output to the person exercising while allowing the person exercising to input or enter selections or commands. In one embodiment, panel 43 comprises a display or monitor and one or more input devices such as switches, touch pads, a touch screen, keyboards, key pads, dials, a microphone with speech recognition software and the like.

Controller 44 (schematically shown) comprises one or more processors or processing devices configured to generate control signals directing the operation of vertical resistance source 42 and height adjuster (if provided) based upon command or selections from the person exercising and sensed exercise metrics such as sensed movement and timed duration of exercise. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 44 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, a person exercising may alter the shape of the path on the fly, while exercising, by simply altering the application of force by his or her feet to foot pads 34. If the person exercising desires a more horizontally shaped or elongated oval path, he or she strides out longer horizontally. This results in foot links 30 (and foot pads 34) swinging back and forth about pivot joint 52 while pivot joint 52 rotates around axis 50. Crank arms 24 makes full and continual revolutions in any given direction for the path shape and feel to function properly so the machine has a fixed vertical stride form but the user can change how much of that they are experiencing by one of multiple available positions on the relatively long foot link 30. An alternative to long foot pads for this purpose is foot pads that are movable to different positions on the foot link Alternatively, at the other extreme, if the person exercising desires a more vertically shaped or elongated oval path for foot pads 34 (and his or her stride), he or she simply takes horizontally shorter strides. Paths between the two noted extremes may be achieved by applying mixtures of horizontal and vertical forces to foot pads 34 and changing user position on the foot links. Although not shown, device 20 may additionally include a source of inertia (a flywheel) to allow crank arms 24 to rotate in a smooth, controllable fashion and provide the flow or follow through between left and right strides.

Figure 2A:
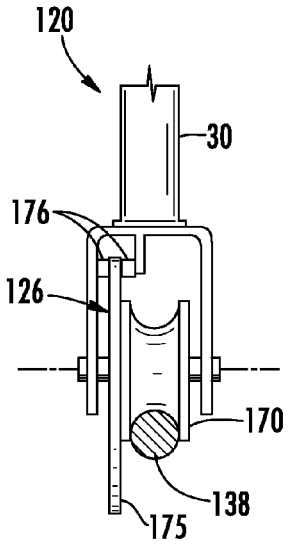
FIG. 2A is a sectional view of a portion of the exercise device of FIG. 2.
Figure 2:
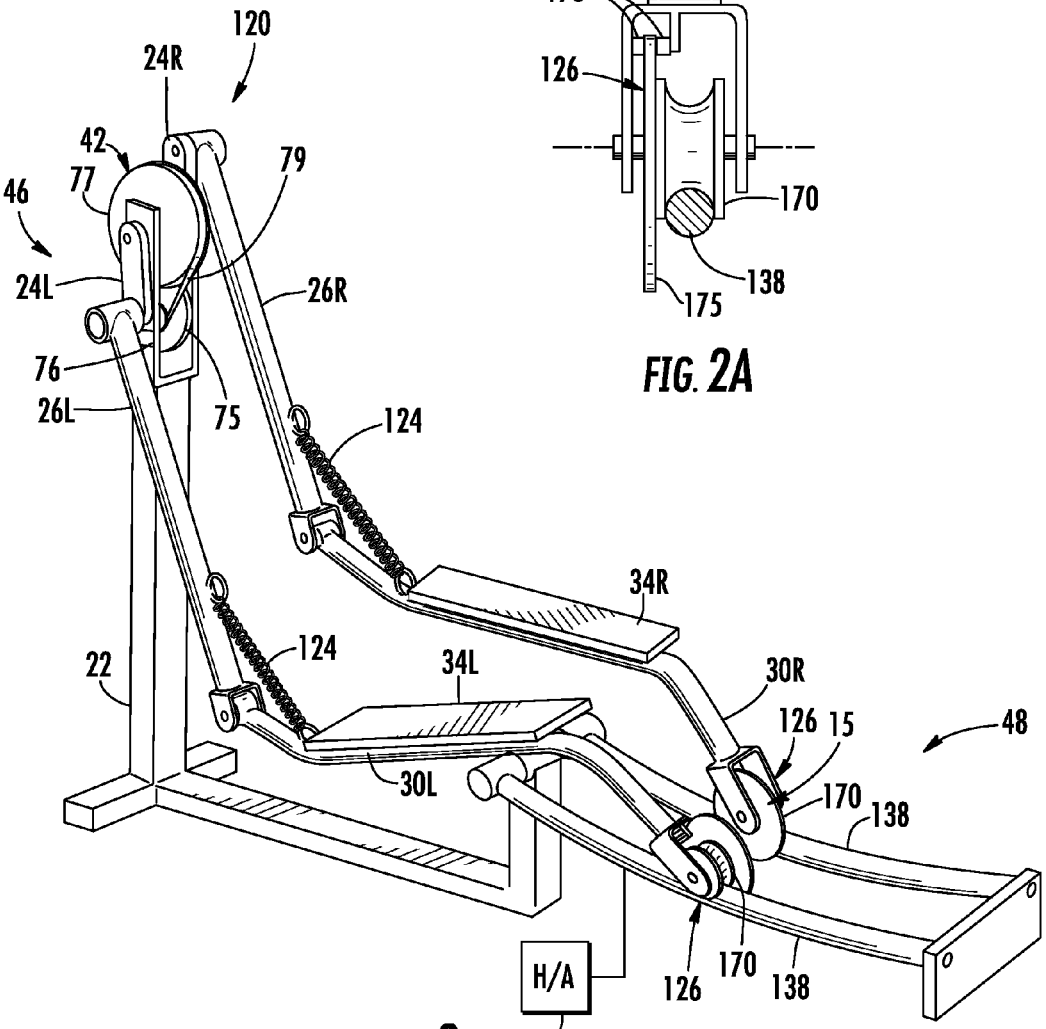
FIG. 2 is a rear perspective view of another embodiment of the exercise device of FIG. 1.
Figure 3:
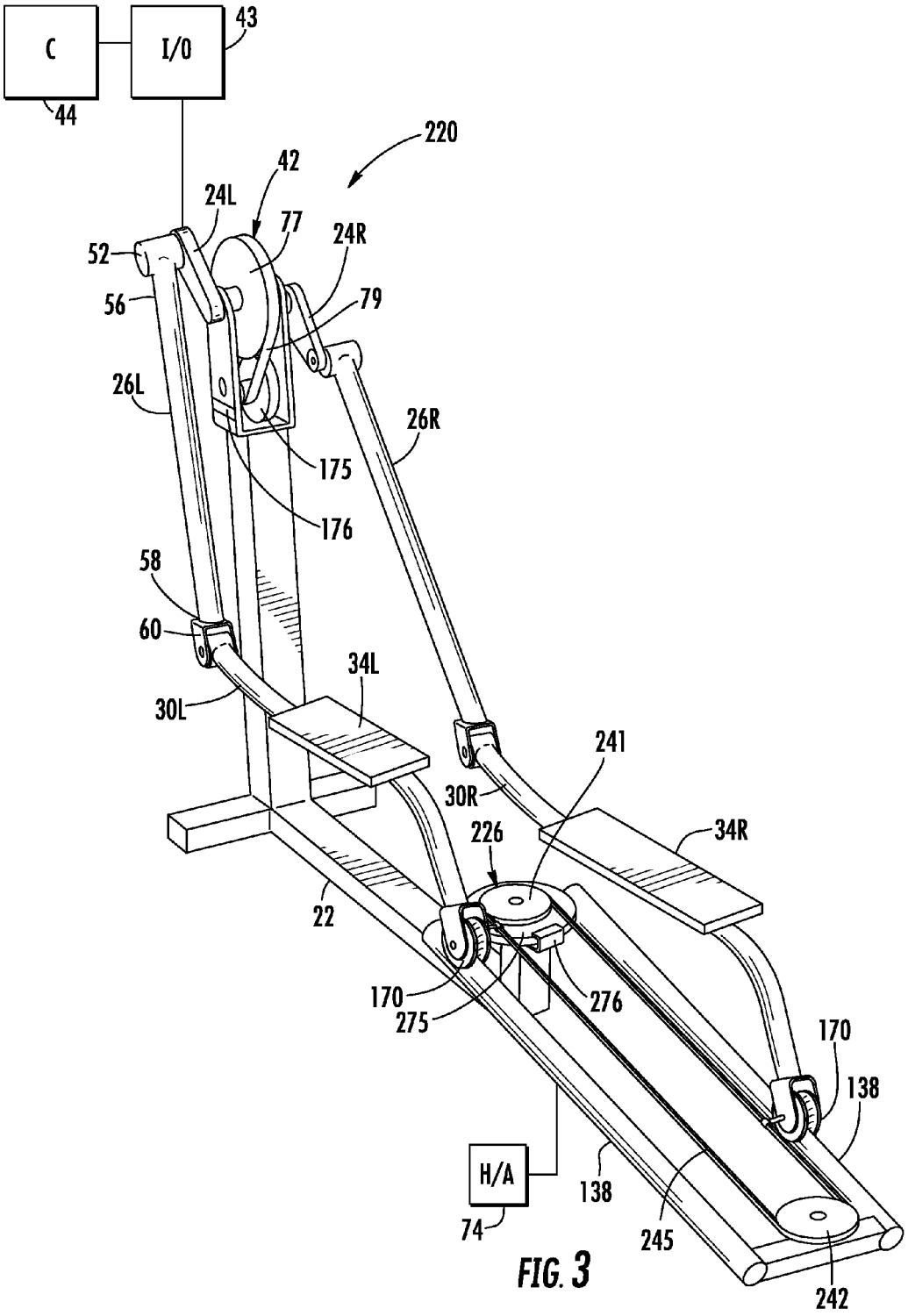
FIG. 3 is a rear perspective view of another embodiment of the exercise device of FIG. 1.

FIGS. 2 and 3 illustrate exercise device 120, another embodiment of exercise device 20. Exercise device 120 is similar to exercise device 20 except that exercise device 120 includes tracks 138 in place of tracks 38 and additionally includes biases 124 and horizontal resistance sources 126. In addition, vertical resistance source 42 includes an intermediate speed increasing disc 77 and belt 79 between crank arms 24 and disc 75 to increase the speed of the disc for inertia and resistance. Those remaining components of exercise device 120 which correspond to exercise device 20 are numbered similarly.

Tracks 138 comprise one or more structures configured to support foot links 30. In the example illustrated, tracks 138 are additionally configured to guide and direct forward and rearward movement of foot links 30. In the example illustrated, tracks 38 comprise two separate tracks guiding foot links 30. Each of tracks 138 is located at the rear of frame, is curved and inclined. In the example illustrated, each of tracks 138 is tubular, wherein the roller 170 of each of foot links 30 is circumferentially grooved to wrap about the tubular or cylindrical shape of the associated track 138. In other embodiments, tracks 138 may alternatively comprise grooves or flat surfaces. In other embodiments, tracks may have inclines at other angles than the particular angle illustrated, may constitute a single track for both foot links 30 and may be linear.

Biases 124 comprise members operably coupled between front arms 26 and foot links 30 so as to resiliently bias foot links 30 towards front arms 26, applying an vertical upward force to foot links 30. In the example illustrated, biases 124 comprise tension springs having one end portion pivotally attached to an associated one of front arms 26 and another end portion pivotally attached to an associated one of foot links 30 forward of foot pads 34 adjacent a front of the associated foot pad 34. In other embodiments, biases 124 may comprise other types of springs or may be omitted.

Horizontal resistance source 126 comprises a mechanism configured provide an adjustable source of resistance against horizontal displacement of foot links 30. Horizontal resistance source 126 resists movement of foot links 30 along tracks 138. In the example illustrated, horizontal resistance source 126 comprises a resistance device 141 associated with each foot link 30. As shown by FIG. 2A, each horizontal resistance source comprises a disc 175 and a magnetic member 176. Disc 175 comprises a nonferrous (aluminum or copper) metal disc coupled to the associated roller 170 and carried by the associated foot link 30 so as to rotate with the roller 170 as it rolls along track 138. Magnetic member 176 comprises a member facing disc 175 and configured to apply a selectively adjustable magnetic field to disc 175 so as to form an eddy brake. In one embodiment, member 176 applies a magnetic field strength under the direction or control of controller 44. In other embodiments, resistance source 126 may be omitted, wherein the resistance is fixed.

Exercise devise 120 operates in a similar fashion to exercise device 20 except that exercise device 120 applies a resistance to horizontal movement of foot pads 34 and applies forces assisting with movement up the incline or ramp provided by tracks 138.

FIG. 3 illustrates exercise device 220, another embodiment of exercise device 20. Exercise device 220 is similar to exercise device 120 except that exercise device 120 includes horizontal resistance source 226 in place of horizontal resistance source 126. Horizontal resistance source 226, like source 126, comprises a mechanism configured provide an adjustable source of resistance against horizontal displacement of foot links 30. Horizontal resistance source 126 resists movement of foot links 30 along tracks 138. In the example illustrated, horizontal resistance source 226 comprises pulleys 241, 242, flexible line or loop 245, disc 275 and a magnetic member 276.

Pulleys 241, 242 comprise rotational line guides rotationally supported by frame 22 at spaced apart locations along tracks 138. Pulleys 241, 242 movably support loop 245 for reciprocal movement along tracks 138. Loop 245 comprises a continuous line, such as a wire, belt, cable or rope. In other embodiments, other rotational guides and loops may be utilized such as a sprockets and a chain. As shown by FIG. 3, loop 245 is coupled or attached to each of foot links 30 such that as foot links 30 reciprocate back and forth along tracks 138, lengths of loop 245 between pulleys 241, 242 also reciprocate back and forth.

Disc 275 comprises a nonferrous (aluminum or copper) disc coupled to pulley 241 so as to rotate with pulley 241 as pulley 241 alternately rotates in opposite directions. In some embodiments, disc 275 may be omitted where pulley 241 is formed from a ferro material and functions as disc 275. Magnetic member 276 comprises a member facing disc 275 and configured to apply a selectively adjustable magnetic field to disc 275 so as to form an eddy brake. In one embodiment, member 276 applies a magnetic field strength under the direction or control of controller 44 (member 276 being wired or wirelessly connected to controller 44). In other embodiments, a similar eddy brake may additionally or alternatively be formed using a disc 275 coupled to pulley 242 and member 276 facing disc 275. In yet other embodiments, resistance source 226 may be omitted, wherein the resistance is fixed. In other examples, the horizontal resistance is fixed at a set rate.

Exercise devise 220 operates in a similar fashion to exercise device 20 except that exercise device 220 utilizes a single eddy brake for providing horizontal resistance to movement of both foot links 30 because left and right are linked through loop 245

Figure 4:
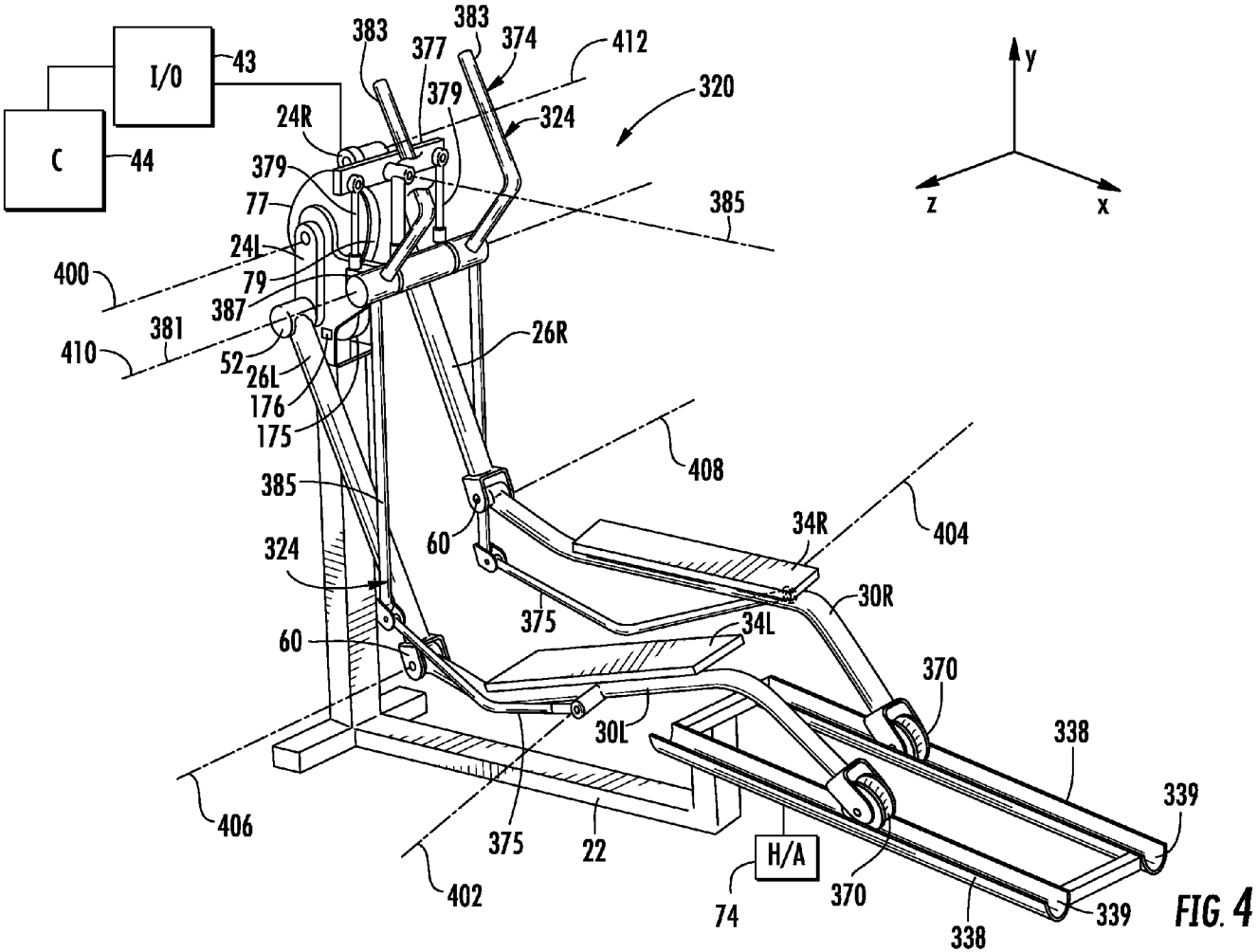
FIG. 4 is a rear perspective view of another embodiment of the exercise device of FIG. 1.

FIG. 4 illustrates exercise device 320, another embodiment of exercise device 20. Exercise device 320 is similar to exercise device 20, except that exercise device 320 includes tracks 338 and swing arm assemblies 324. Although not illustrated, exercise device 320 includes either horizontal resistance source 126 or horizontal resistance source 226 along tracks 338. In embodiments where resistance source 226 is used, links 375 and rocker arm 377 may be omitted.

Tracks 338 comprise one or more structures configured to support foot links 30. In the example illustrated, tracks 138 are additionally configured to guide and direct forward and rearward movement of foot links 30. In the example illustrated, tracks 338 comprise two separate tracks guiding foot links 30. Each of tracks 338 is located at the rear of frame, is linear and inclined. In the example illustrated, each of tracks 138 provides a groove or channel 339, wherein the rollers 370 of each of foot links 30 is received within the channel 339 and rolls along the channel. In other embodiments, tracks 338 may alternatively comprise tubular or flat surfaces. In other embodiments, tracks may have inclines at other angles than the particular angle illustrated, may constitute a single track for both foot links 30 and/or may be curved.

Swing arm assemblies 324 comprise mechanisms configured to exercise a person's upper body and arms by facilitating the application of force by the upper body to foot links 30. Swing arm assemblies 324 comprise swing arms 374, connecting links 375, rocker arm 377 and rocker arm links 379. Swing arms 374 comprise elongate members rotationally supported by frame 22 at or proximate to forward end 46 for pivotal movement about horizontal axis 381. Each swing arm 374 includes an upper portion 383 above axis 381 serving as a hand grip and a lower portion 385 below axis 381 and pivotally connected to link 375. Swing arms 374 swing to and fro about axis 381. Although axis 381 is illustrated as being offset from axis 50 of disc 77, in other embodiments, axis 381 may be collinear with axis 50 provided it is not operably attached to the rotation of the cranks on axis 50. In other words, swing arms 374 and cranks 24 may employ the same shaft making axis 50 and axis 381, wherein swing arms 374 and crank arms 24 are not connected to each other.

Links 375 comprise members operably coupled between swing arms 374 and foot links 30. Links 375 have a first end pivotally connected to swing arm 374 and a second end pivotally connected to foot link 30. In the example illustrated, links 375 are pivotally connected to foot link 30 proximate a center point of the associated foot pad 34. Links 375 transmit force from swing arms 324 to foot links 30 while also permitting foot links 30 to be vertically displaced without fore and aft movement (or with minimal fore and aft movement) of swing arms 374.

Rocker arm 377 and rocker arm links 379 cooperate to force alternating fore and aft reciprocation of swing arms 374 about axis 381. Rocker arm 377 comprises a member pivotally supported by frame 22 for pivotal movement about axis 385 extending in the x-axis direction). Rocker arm links 379 comprise members pivotally connected to rocker arm 377 at a first end (for rotation about an axis extending in the x-axis direction) and pivotally connected to an associated swing arm 374 by a hinge 387 at a second end offset from axis 381 (for rotation about an axis extending in the z-axis direction). In operation, as one swing arm 374 moves forwardly, the other of swing arms 374 moves rearwardly. In other embodiments, rocker arm 377 and links 379 may have other configurations. In other embodiments, rocker arm 377 and links 379 may be omitted.

Exercise devise 320 operates in a similar fashion to exercise device 20 except that exercise device 320 applies a resistance to horizontal movement of foot pads 34 (through the use of horizontal resistance source 126 or 226 shown in FIGS. 2 and 3, respectively) and allows the person exercising to additionally exercise his or her upper body using swing arms 374.

FIG. 4 illustrates the various axes about which the interconnected components rotate or pivot. In the example illustrated, crank arms 24 rotate about a first axis 400. Connecting links 375 are pivotally coupled to foot links 30L and 30R about a second axis 402 and a third axis 404. Front arms 26L and 26R are pivotally connected directly to the first and second foot links 30L and 30R about a fourth axis 406 and fifth axis 408, respectively, provided by pivot joints 60. Front arms 26L and 26R are pivotally connected to crank arms 24L and 24R about a sixth axis 410 and a seventh axis 412, respectively.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a frame;

first and second crank arms configured to rotate 180 degrees out of phase with respect to one another about a first axis;

at least one track;

first and second foot links, each of the first and second foot links having a first link portion configured to move along the at least one track while pivoting and a second link portion;

first and second footpads carried by the first and second foot links between the first link portion and the second link portion;

first and second swing arms pivotally supported by the frame about a second axis fixed relative to the frame, the second axis being vertically below the first axis;

first and second connecting links operably coupled between the first and second swing arms and the first and second foot links, the first and second connecting links being pivotally connected directly to the first and second foot links about third and fourth axes, respectively;

first and second front arms, each of the first and second front arms having a first arm portion pivotally connected directly to the second link portion of one of the foot links for pivotal movement about a fifth axis and a second arm portion pivotally connected directly to one of the crank arms for pivotal movement about a sixth axis, the fifth axis and the sixth axis each being different than the third and fourth axes; and a first adjustable resistance source operably coupled to the first and second crank arms.

2. The exercise device of claim 1, wherein the at least one track comprises at least one inclined ramp.

3. The exercise device of claim 1, wherein the first and second footpads each have a first length and wherein the first and second front arms each have a second length greater than the first length.

4. The exercise device of claim 1, wherein the fifth and sixth axes are rearward of the first axis and in front of the first and second footpads, respectively.

5. The exercise device of claim 1, wherein the first link portion of each of the first and second foot links rotatably supports a roller to roll along the at least one track.

6. An exercise device comprising:

a frame;

first and second crank arms configured to rotate 180 degrees out of phase with respect to one another about a first axis;

at least one track;

first and second foot links, each of the first and second foot links having a first link portion rotatably supporting a roller in contact with the at least one track so as to move along the at least one track while pivoting and a second link portion;

first and second footpads carried by the first and second foot links between the first link portion and the second link portion;

first and second swing arms pivotally supported by the frame;

first and second connecting links operably coupled between the first and second swing arms and the first and second foot links, the first and second connecting links being pivotally coupled directly to the first and second foot links about second and third axes; and first and second front arms pivotably connected directly to the first and second foot links about fourth and fifth axes, respectively, the fourth and fifth axes being different than the second and third axes, each of the first and second front arms being pivotally coupled to one of the crank arms such that a shape of a continuous looping path of the first and second footpads automatically changes solely in response to different horizontal and vertical forces being applied by a person to the first and second footpads, wherein the first and second swing arms are pivotally connected directly to the frame for pivotal movement about a sixth axis that is fixed relative to the frame and wherein the first axis is vertically above the sixth axis.

7. The exercise device of claim 6, wherein the first and second footpads each have a first length and wherein the first and second front arms each have a second length greater than the first length.

8. The exercise device of claim 6, wherein the second and third axes are rearward of the first axis and in front of the first and second footpads, respectively.

* * * * *